US006685182B2

(12) United States Patent
Berti et al.

(10) Patent No.: US 6,685,182 B2
(45) Date of Patent: Feb. 3, 2004

(54) SHEET-FED PRINTING MACHINE AND METHOD OF OPERATION

(75) Inventors: Christopher Berti, Dielheim (DE); Bernd Herrmann, Malsch (DE); Kurt Lötsch, Wiesenbach (DE); Arnd Schmidt, Edingen (DE); Ulrike Weisbrodt, Ilvesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 110 days.

(21) Appl. No.: 09/825,185

(22) Filed: Apr. 3, 2001

(65) Prior Publication Data

US 2002/0007746 A1 Jan. 24, 2002

(30) Foreign Application Priority Data

Apr. 3, 2000 (DE) ..... 100 16 526

(51) Int. Cl.[7] ..... B65H 3/24
(52) U.S. Cl. ..... 271/42; 271/268; 271/84
(58) Field of Search ..... 271/42, 267, 268, 271/84

(56) References Cited

U.S. PATENT DOCUMENTS

| | | | |
|---|---|---|---|
| 5,533,448 | A | 7/1996 | Klingler |
| 5,651,544 | A | 7/1997 | Stadler |
| 6,000,694 | A | 12/1999 | Krüger et al. |
| 6,293,193 | B1 | 9/2001 | Bolza-Schünemann |
| 6,349,643 | B1 | 2/2002 | Loftus et al. |

FOREIGN PATENT DOCUMENTS

| | | |
|---|---|---|
| DE | 644 080 | 4/1937 |
| DE | 914 496 | 7/1954 |
| DE | 952 348 | 11/1956 |
| DE | 38 09 740 C1 | 3/1989 |
| DE | 195 03 739 C1 | 4/1996 |
| DE | 195 15 077 A1 | 10/1996 |
| DE | 196 16 755 A1 | 11/1997 |
| DE | 197 20 741 A1 | 11/1998 |
| EP | 0 645 242 A1 | 3/1995 |
| WO | 98/52758 | 11/1998 |
| WO | 99/32292 | 7/1999 |

*Primary Examiner*—David H. Bollinger
(74) *Attorney, Agent, or Firm*—Laurence A. Greenberg; Werner H. Stemer; Ralph E. Locher

(57) ABSTRACT

A sheet-fed printing machine having a feed system for feeding sheets from a sheet feeder to the sheet-fed printing machine, and an imaging device for setting an image on a printing plate disposed on the plate cylinder are provided. The feed system includes at least one oscillatingly moving pregripper and a drive device for the feed system, the pregripper being uncoupled from the drive device.

18 Claims, 8 Drawing Sheets

SHEET-FED PRINTING MACHINE AND METHOD OF OPERATION

BACKGROUND OF THE INVENTION

FIELD OF THE INVENTION

The invention relates to a sheet-fed printing machine having at least one feed system for feeding sheets thereto from a feeder, the sheet-fed printing machine having at least one front lay serving to align the leading edge of the sheets to be processed, and a method of operating the sheet-fed printing machine.

The published German Patent Document DE 195 03 739 C1 reveals a sheet-fed printing machine of the type mentioned hereinbefore. It has, amongst other components, a feeder, a front lay, a pre-gripper including a gripper bar, and a feed cylinder. The front lay and the gripper bar are constructed so as to be pivotable and are coupled to the drive of the sheet-fed printing machine so as to be displaced at the cycle rate of the machine. The stacked sheets are separated in the feeder and subsequently aligned by the front lay so that the leading edge thereof extends exactly transversely with respect to the transport direction of the sheets. At the front lay, the sheet is gripped by the gripper bar and transported onwards to the feed cylinder. When preparing for a new print job, wherein a new printing image is to be printed onto the sheets, the feeding of the sheets in the feeder is stopped and at least one plate cylinder within the sheet-fed printing machine has an image set thereon directly with the aid of a laser, in an inkjet method, by thermal transfer or the like. During the setting of the image or imaging operation, the drives of the sheet-fed printing machine continue to run operatively, as well, the feed roller, amongst others, thus rotating at machine speed, and the front lay and the gripper bar being displaced oscillatingly at a corresponding speed. As a result of the movements of the front lay and the gripper bar, oscillations are introduced into the machine and tend to disrupt the setting of the image on the plate cylinder. It is often the case that, in order to set the image, the machine speed is increased to such an extent that it corresponds to a printing throughput of 16,000 sheets per hour or more, for example. As a result, the oscillations produced by the oscillating pre-gripper and front lay are further amplified.

SUMMARY OF THE INVENTION

It is therefore an object of the invention to provide a sheet-fed printing machine of the type mentioned at the introduction hereto, and a method that can be implemented therewith, wherein disruptions caused by oscillations during the setting of an image or imaging operation can be avoided, at least to a great extent.

With the foregoing and other objects in view, there is provided, in accordance with one aspect of the invention, a sheet-fed printing machine having a feed system for feeding sheets from a sheet feeder to the sheet-fed printing machine, and an imaging device for setting an image on a printing plate disposed on the plate cylinder, the feed system comprising at least one oscillatingly moving pregripper and a drive device for the feed system, the pregripper being uncoupled from the drive device.

In accordance with another feature of the invention, the sheet-fed printing machine includes a lever mechanism for driving the pregripper.

In accordance with a further feature of the invention, the pregripper has at least one gripper bar which is displaceable at the cyclic rate of the printing machine.

In accordance with an added feature of the invention, the displacement at the cyclic rate of the printing machine is non-uniform.

In accordance with an additional feature of the invention, the displacement at the cyclic rate of the printing machine is in an oscillatory manner.

In accordance with yet another feature of the invention, the pregripper is disposed between the sheet feeder and a feed cylinder.

In accordance with yet a further feature of the invention, the sheet-fed printing machine includes a blocking device for blocking the lever mechanism in a given functional position.

In accordance with yet an added feature of the invention, the drive device is constructed as a cam drive having at least one cam disk connected to a drive shaft so as to be fixed against rotation relative thereto, the cam disk cooperating with a first pivoting lever of the lever mechanism, and being pivotable about a fixed axis.

In accordance with yet an additional feature of the invention, the sheet-fed printing machine includes a pressing device for pressing the first pivoting lever against the cam disk.

In accordance with still another feature of the invention, the lever mechanism has a second pivoting lever connected to a shaft for the pregripper so as to be fixed against rotation relative thereto, and a gripper bar is fixed to the pregripper shaft.

In accordance with still a further feature of the invention, the pressing device is in cooperative engagement with at least one of the pregripper shaft and the second pivoting lever.

In accordance with still an added feature of the invention, the first and the second pivoting levers are articulatedly connected to a coupling element.

In accordance with still an additional feature of the invention, the first pivoting lever has at least one supporting roller which, in a non-blocked state of the lever mechanism, rolls on the cam disk, the supporting roller, in a blocked state of the lever mechanism, being located at a given distance from the rotating cam disk.

In accordance with another feature of the invention, the gripper bar has at least one gripper, and the feed system includes a feed cylinder formed, for the at least one gripper, with a respective circumferential groove into which the at least one gripper is dippable as it approaches the feed cylinder.

In accordance with a further feature of the invention, the gripper bar has a plurality of grippers, and the feed system includes a feed cylinder formed, for the plurality of grippers, with a plurality of respective circumferential grooves into which the grippers, respectively, are dippable as they approach the feed cylinder.

In accordance with an added feature of the invention, a respective circumferential groove is of such depth that even when the at least one gripper is at a minimal distance from the axis of rotation of the feed cylinder, there is an interspace between the at least one gripper and the bottom of the respective circumferential groove.

In accordance with another aspect of the invention, there is provided a sheet-fed printing machine having a feed system for feeding sheets from a sheet feeder to the sheet-fed printing machine, and an imaging device for setting an image on a printing plate disposed on a plate cylinder, the feed system comprising at least one reciprocatingly pivotable front lay and a drive device for the front lay, the front lay being uncouplable from the drive device.

In accordance with a further feature of the invention, the sheet-fed printing machine includes a displacement device having a lever mechanism which is displaceable by the drive device.

In accordance with an added feature of he invention, the displacement of the lever mechanism is non-uniform.

In accordance with an additional feature of the invention, the displacement of the lever mechanism is in an oscillating manner.

In accordance with yet another feature of the invention, the drive device is constructed as a cam drive having at least one cam disk connected to a drive shaft so as to be fixed against rotation relative thereto, the cam disk cooperating with a roller lever, and being pivotable about a fixed first pivot shaft.

In accordance with yet a further feature of the invention, the lever mechanism has a coupling rod articulatedly connected to a roller lever and a lever arm having the front lay and being pivotable about a fixed second pivot shaft.

In accordance with yet an added feature of the invention, as viewed in vertical direction, in a raised position of the coupling rod, the front lay is displaceable into an aligning position and, in a lowered position of the coupling rod, is displaceable into a standby position.

In accordance with yet an additional feature of the invention, the sheet-fed printing machine includes a pressing device assigned to the lever mechanism for applying a force to the lever mechanism so that at least one supporting roller of the roller lever is pressed against the cam disk.

In accordance with still another feature of the invention, the sheet-fed printing machine includes a blocking device assigned to the lever mechanism by which the coupling rod can be raised to such an extent that the roller lever is out of contact with the cam disk.

In accordance with still a further feature of the invention, at least one imaging device is integrated into the sheet-fed printing machine.

In accordance with an added aspect of the invention, there is provided a method of operating a sheet-fed printing machine having a feed system for feeding sheets from a feeder to the sheet-fed printing machine, which comprises providing an imaging device for setting an image on a printing plate disposed on a plate cylinder, and uncoupling parts of at least one of the feeder and at least one feed system for transporting the sheets from a drive, while the image is being set on the printing plate.

In accordance with a concomitant mode, the method of the invention comprises uncoupling at least one of a gripper bar of a pregripper and a front lay from the drive.

The sheet-fed printing machine according to the invention thus has at least one feed system for feeding sheets from a feeder to the sheet-fed printing machine, and a drive device for the feed system. The sheet-fed printing machine is distinguished by the fact that the feed system can be uncoupled from the drive device. It is therefore possible to ensure that, for example, during the setting of an image on a printing device, in particular a printing plate or a plate cylinder, the feed system is, so to speak, stopped, so that with the machine running or the drive running, no oscillations which could disrupt the setting of an image are produced by the feed system.

In an advantageous exemplary embodiment of the sheet-fed printing machine, the feed system has a pregripper that can be driven with the aid of a lever mechanism and preferably has at least one gripper bar which can be displaced at the cyclic rate of the machine. The drive device can co-operate directly with the lever mechanism here, i.e., the lever mechanism can be uncoupled from the drive device. The gripper bar can be displaced, for example, non-uniformly or in an oscillatory manner.

In a preferred embodiment, the lever mechanism can be blocked in a specific functional position with the aid of a blocking device, i.e., the lever mechanism can be stopped during the operation of the sheet-fed printing machine. In order, at the same time, to rule out any damage to the drive and to the lever mechanism, for example, a clutch can be provided between the lever mechanism and the drive.

In a particularly advantageous exemplary embodiment, the drive device is constructed as a cam drive, which has at least one cam disk firmly connected to a drive shaft so as to rotate therewith and which cooperates with a first pivoting lever belonging to the lever mechanism, and can be pivoted about a fixed axis. The functional position, wherein the lever mechanism can be blocked in this exemplary embodiment, so as to prevent an oscillatory movement of the gripper bar, has preferably been reached when that part of the lever mechanism which cooperates with the cam disk during the printing of the sheets is at its greatest distance from the axis of rotation of the cam disk. Therefore, in spite of the blocking of the lever mechanism, the cam disk can continue to rotate, without resulting in any damage to the lever mechanism.

In an advantageous embodiment of the sheet-fed printing machine, the blocking device is constructed so that it cannot only block the lever mechanism, i.e., prevent it from moving, but can also move the lever mechanism at least to such an extent that there is a distance X between the cam disk and that part of the lever mechanism which rolls on the cam disk, for example, a supporting roller. When the lever mechanism is blocked, the rotating cam disk is therefore out of contact with the mechanism, so that, in the uncoupled state, no wear occurs on the cam disk or the lever mechanism. The distance X may be very small and, for example, may be 2 mm to 3 mm.

According to a development of the invention, provision is made for the first pivoting lever to be capable of being pressed against the cam disk with the aid of a pressing device. The pressing device prevents the first pivoting lever from lifting off the cam disk. The pressing device therefore acts upon the lever mechanism with a spring force, counter to which the cam disk displaces the lever mechanism in order to displace the gripper bar in an oscillatory manner. The pressing device can include, for example, a pull rod which cooperates with a spring element, for example a cylindrical helical spring, and is effectively connected to the lever mechanism. It is also conceivable for the pressing device to have a pneumatic piston/cylinder unit.

In order to achieve the objective of the invention, a sheet-fed printing machine is therefore proposed which has at least one front lay thst serves to align the leading edge of the sheets to be processed and that can be displaced at the cyclic rate of the machine by a displacement device that can be driven by a drive device. The sheet-fed printing machine is distinguished by the fact that the displacement device can be uncoupled from the drive device. Based upon this configuration, it is possible to ensure that, in the uncoupled state, the displacement device can be brought to a standstill with the machine running. This is particularly advantageous when setting an image on a plate cylinder or the like with the sheet-fed printing machine running, by an imaging device preferably integrated in the sheet-fed printing machine, because oscillations produced by the front lay or the displacement device, which could disrupt the setting of an image, are avoided.

In an advantageous exemplary embodiment of the sheet-fed printing machine, the displacement device has a lever mechanism which can be displaced by the drive device, preferably non-uniformly or in an oscillatory manner, this mechanism being actable upon with a torque by the drive device, which is preferably formed by the machine drive, and can be uncoupled from the drive device.

Particularly preferred is an exemplary embodiment of the sheet-fed printing machine wherein at least one imaging device is integrated in the sheet-fed printing machine. The imaging device is therefore a part of the sheet-fed printing machine, so that setting an image on a printing device, which, for example, can have a plate cylinder that can be driven and has a printing film, can be performed directly in the sheet-fed printing machine. The imaging device can, for example, have at least one device for performing a thermal transfer and/or an inkjet method and/or a laser device or the like.

In order further to achieve the objective of the invention, a method of operating a sheet-fed printing machine is provided which is distinguished by the fact that while an image is being set on a printing device integrated in the sheet-fed printing machine, parts of a feeder and/or at least one feed system for transporting the sheets are uncoupled from the drive. This makes it possible to ensure that these devices do not produce any oscillations which could be introduced into the sheet-fed printing machine and have a disruptive effect upon the setting of an image on the printing device which, for example, has a plate cylinder.

According to a development of the invention, provision is made that, while setting an image on the printing device preferably formed by a plate cylinder, a gripper bar of a pregripper and/or a front is or are uncoupled from the drive. The gripper bar and the pregripper are preferably at a standstill so that these devices do not produce any oscillations. It becomes clear that, in this connection, uncoupling the drive is understood to mean separating the gripper bar and/or the pregripper from the machine drive, so that, during imaging or the setting of an image, other, in particular rotating components or devices in the sheet-fed printing machine, such as a feed cylinder, guide rolls, a plate cylinder or the like, can continue to run at a non-reduced speed (printing speed) or an increased machine speed (imaging speed).

Other features which are considered as characteristic for the invention are set forth in the appended claims.

Although the invention is illustrated and described herein as embodied in a sheet-fed printing machine and method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
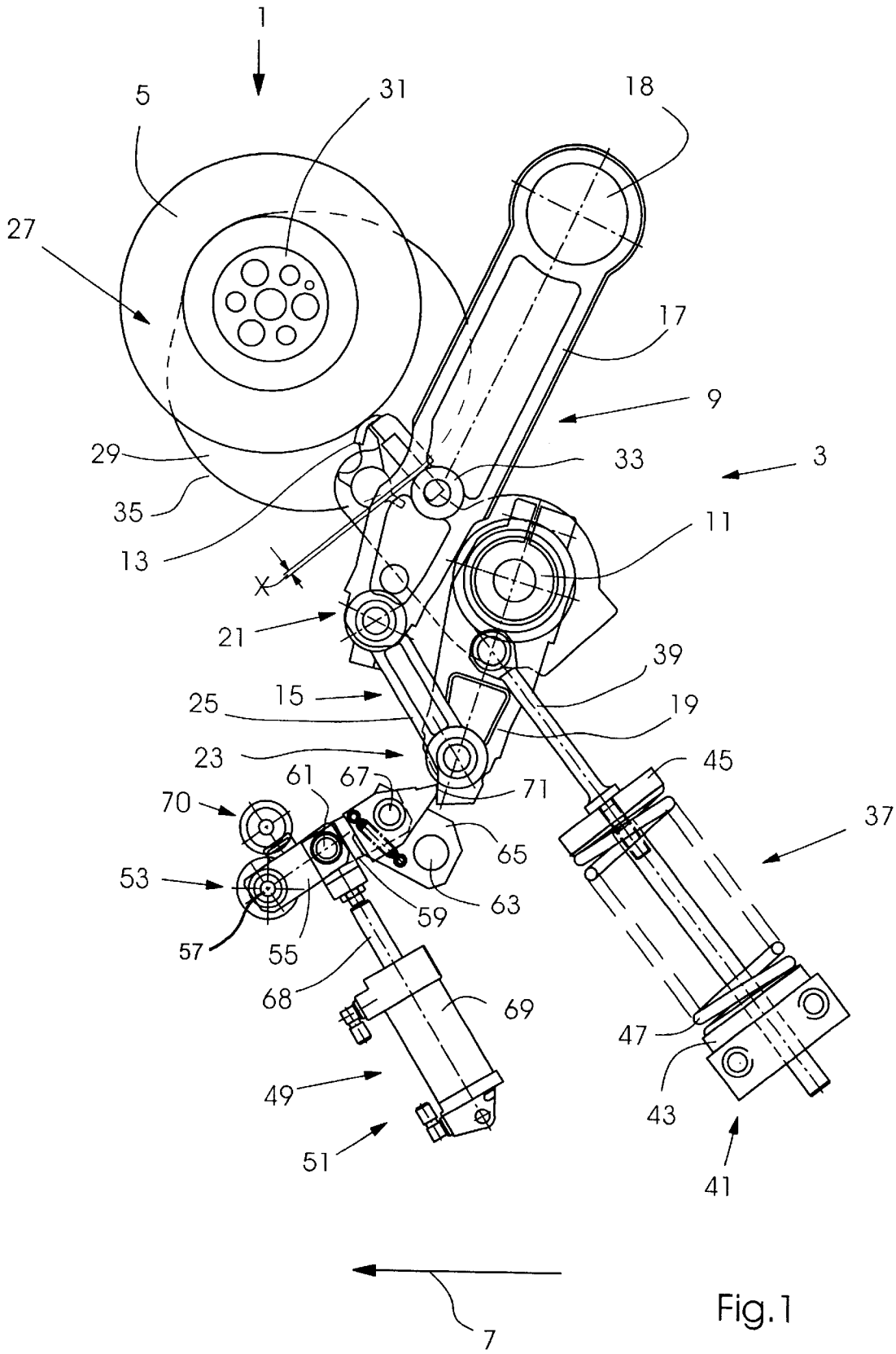
FIGS. 1 and 2 are side elevational views in different phases of operation, respectively, of an exemplary embodiment of a lever mechanism for displacing a gripper bar of a pregripper.

Referring now to the drawings and, first, particularly to FIG. 1 thereof, there is shown therein a fragment of an exemplary embodiment of a sheet-fed printing machine 1, which has a feed system including a pregripper 3. The pregripper 3 is arranged in a region between a feeder (not illustrated) and a feed cylinder 5. The feed cylinder 5 is arranged downline of the pregripper 3, as viewed in the transport direction of the sheets. The pregripper 3 includes a gripper bar 9 (not specifically illustrated) which is firmly coupled, so as to be fixed against relative rotation, with a pregripper shaft 11 extending transversely with respect to the transport direction represented by the arrow 7. The gripper bar 9 has a number of grippers arranged one behind another and at a distance from one another, of which only the gripper 13 can be seen in the illustration of FIG. 1. The gripper bar 9 serves for accepting the sheets separated in the feeder at a front lay (not illustrated), and to transport them onwards to the feed cylinder 5. For this purpose, the gripper bar 9, together with the pregripper shaft 11, is oscillatingly displaced about the longitudinal mid-axis of the pregripper shaft 11 extending perpendicularly to the plane of FIG. 1, i.e., is pivoted in clockwise and counterclockwise directions, at the cycling rate of the sheet-fed printing machine.

For the purpose of pivoting the gripper bar 9, a lever mechanism 15 is provided, which includes a first pivoting lever 17 that is pivotable about a fixed shaft 18, and a second pivoting lever 19 that is firmly connected to the pregripper shaft 11 so as to rotate therewith. The shaft 18 is disposed above the feed cylinder 5, and the pregripper shaft 11 is disposed at a distance from the shaft 18, underneath the latter and the feed cylinder 5. The first pivoting lever 17 is connected to a coupling element 25 via an articulated joint 21, and the second pivoting lever 19 is connected to the coupling element 25 via an articulated joint 23.

Also provided is a drive device 27 for driving the lever mechanism 15 which, in this exemplary embodiment, is constructed as a cam drive and has a cam disk 29 which is firmly connected to a drive shaft 31 so as to rotate therewith. The drive shaft 11, which is effectively connected to the drive of the sheet-fed printing machine 1, is at the same time also the drive shaft of the feed cylinder 5, from which it is readily concluded that the cam disk 29 in this exemplary embodiment is fixed to one end of the feed cylinder 5.

Figure 2:
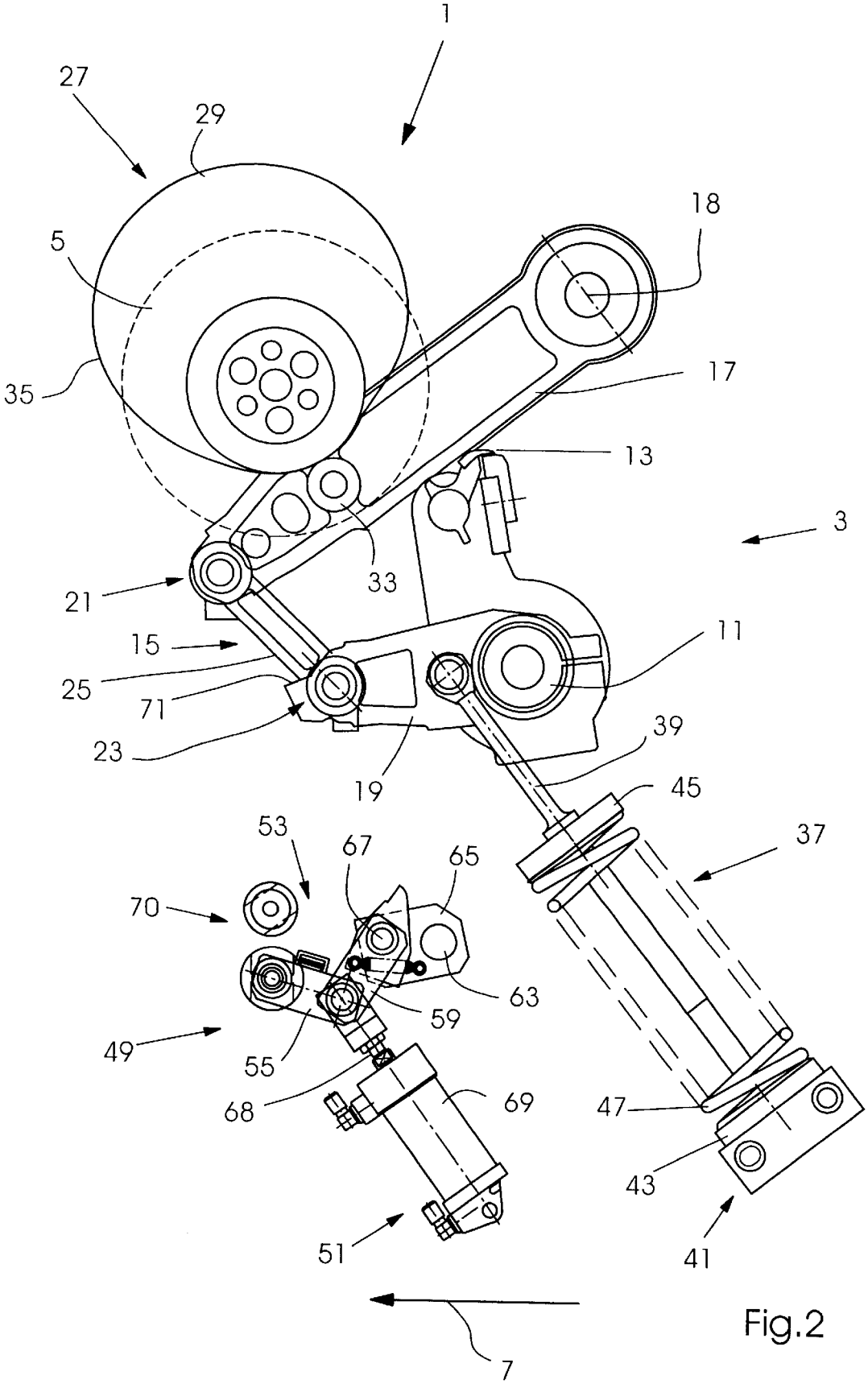

The first pivoting lever 17 of the lever mechanism 15 has a supporting roller 33, with which it can be pressed against the outside of the cam disk 29 (FIG. 2). During rotation of the cam disk 29, the supporting roller 33 rolls on the outer circumferential face 35 of the cam disk 29. In the position of the lever mechanism 15 that is shown in FIG. 1, the supporting roller 33 is disposed at a distance X from the outer circumferential face 35 of the cam disk 29. The distance X may be only a few millimeters.

In order to press the supporting roller 33 against the cam disk 29, a pressing device 37 is provided, which has a push rod 39 that is connected articulatedly to the second pivoting lever 19 and is displaceable in the direction of the longitudinal mid-axis thereof with respect to a fixed base 41. Provided on the base 41 is a pad 43, between which and a pressure plate 45 screwed onto the push rod 39, a spring element 47 is arranged which, in the position of the lever mechanism 15 illustrated in FIG. 1, and, via the pressure plate 45, acts upon the push rod 39 with a compressive force oriented in the direction of the cam disk 29.

In the position shown in FIG. 1, the lever mechanism 15 is blocked with the aid of a blocking device 49, i.e., is prevented from moving. The gripper bar 9 is, therefore, at a standstill. The blocking device 49 has a piston/cylinder unit 51 which can be operated hydraulically or pneumatically, and a toggle joint 53, which includes a first one-armed lever 55 that is pivotable about a fixed axis 57, and a second one-armed lever 59. The latter is articulatedly connected to the first lever 55 via a joint 61. In addition, the blocking device 49 has a blocking element 65 which is pivotable about a fixed shaft 63 and is connected to the second lever 59 via an articulated joint 67. Connected to the articulated joint 61 is a piston rod 68 belonging to the piston/cylinder unit 51, which is accommodated in a housing 69 and can be displaced in the direction of the longitudinal mid-axis thereof. In FIG. 1, the piston rod 68 has been extended to such an extent that the first lever arm 55 strikes against a fixed stop 70. In the process, the blocking element 65 is pivoted to such an extent that it presses with a nose-like protrusion against a stop face 71 on the second pivoting lever 19 of the lever mechanism 15 and prevents the latter from executing a pivoting movement in the counterclockwise direction. The blocked lever mechanism 15 is therefore at a standstill. The second pivoting lever 19 has been pivoted outwardly, with the aid of the blocking device 49, beyond an end position, wherein the supporting roller 33 remains pressed against the cam disk 29 and which the pivoting lever 19 cannot reach without the blocking device 49.

From FIG. 1, it can readily be seen that the lever mechanism 15 is constructed as a toggle joint.

The function of the foregoing devices is explained in greater detail hereinafter.

During the operating phase of the sheet-fed printing machine 1, wherein the sheets (not illustrated) are printed, the blocking device 49 is inactive, i.e., the lever mechanism 15 is not blocked by the blocking element 65. The latter has been pivoted in the clockwise direction, by retracting the piston rod 68 into the housing 69 of the piston/cylinder unit 51, to such an extent that the second pivoting lever 19 can pass it, while the lever mechanism 15 oscillatingly displaces the gripper bar 9. When the lever mechanism 15 is released, i.e., not blocked, the second pivoting lever 19 is acted upon by the pressing device 37 with such a force that it is pivoted in the counterclockwise direction to such an extent that the supporting roller 33 on the first pivoting lever 17 is pressed against the outer circumferential face 35 of the cam disk 29. During the rotation of the cam disk 29, the first and the second pivoting levers 17 and 19 are displaced in accordance with the outer contour of the cam disk 29, and therefore so is the gripper bar 9 which, together with the pregripper shaft 11, are pivoted in the clockwise and counterclockwise direction about the longitudinal mid-axis thereof.

Figure 3:
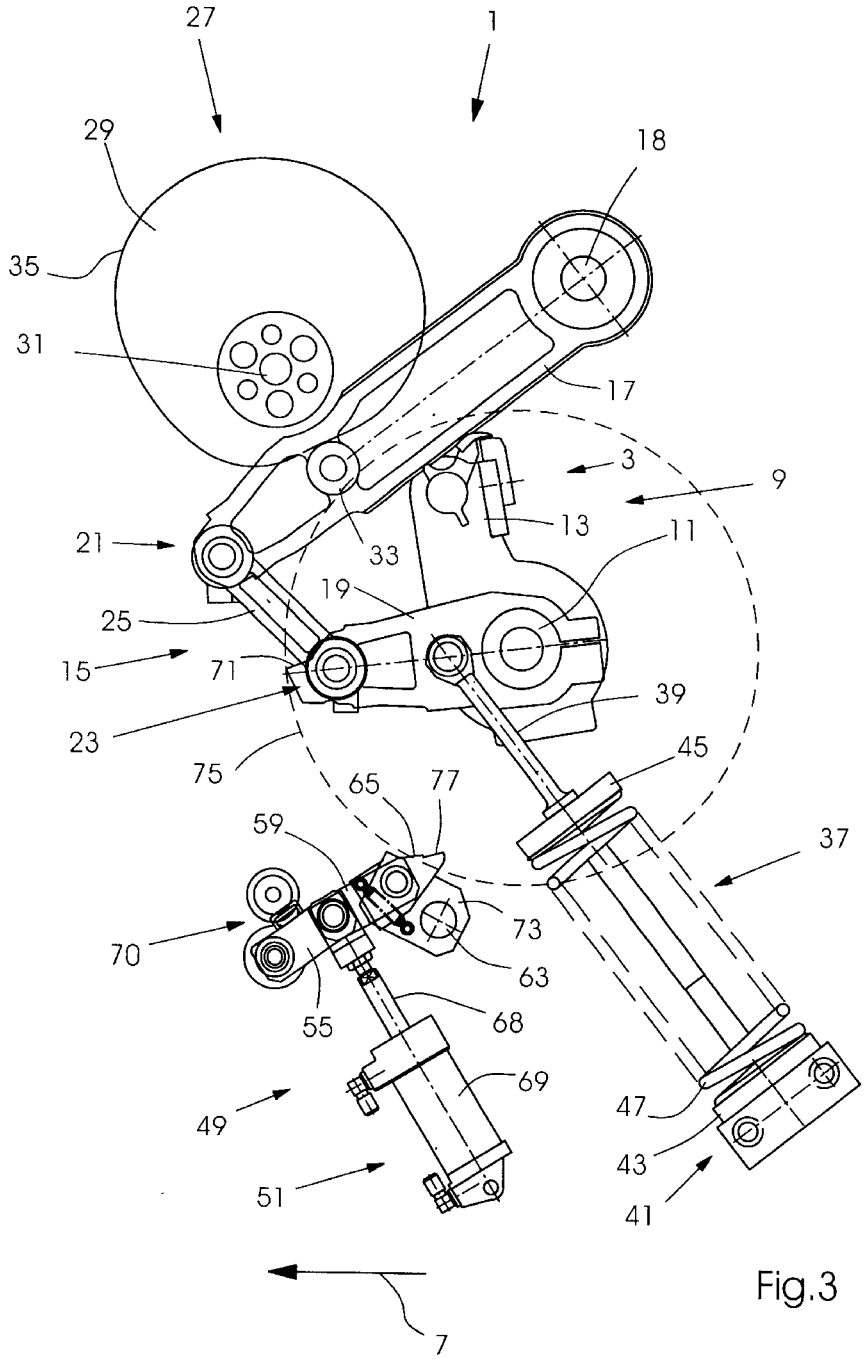
FIG. 3 is a side elevational view, in a further phase of operation, of the lever mechanism shown in FIGS. 1 and 2, and a further exemplary embodiment of a blocking device for blocking the lever mechanism.

In the position of the lever mechanism 15 illustrated in FIG. 2, the gripper bar 9 has been displaced into a position wherein it can accept a sheet from the feeder (note also FIG. 3). Before a plate cylinder (not illustrated) belonging to the sheet-fed printing machine 1 has an image set or formed thereon, the lever mechanism 15 is uncoupled from the drive device 27. This is effected by the fact that, after the second pivoting lever 19 of the lever mechanism 15 has passed the blocking element 65 of the blocking device 49, which is arranged in the standby position, the piston rod 68 of the piston/cylinder unit 51 is extended, as a result of which the blocking element 65 is displaced in the counterclockwise direction from the standby position thereof illustrated in FIG. 2 into the blocking position thereof illustrated in FIG. 1. In the blocked state of the lever mechanism 15, the latter is at a standstill, and the supporting roller 33 is preferably at the distance X from the cam disk 29, so that the latter can continue to rotate without damaging the lever mechanism 15.

While an image is being set or formed on the plate cylinder within the sheet-fed printing machine by a laser or the like, no oscillations are therefore produced by the lever mechanism 15, as in conventional sheet-fed printing machines, which can lead to faults in the printing image applied to the plate cylinder. In order to be able to perform the setting of an image or the imaging operation quickly, the speed of the sheet-fed printing machine can be increased from, for example, 10,000 sheets per hour during the printing of the sheets to a speed which would correspond to a throughput of, for example, 16,000 sheets per hour.

In order to restart the printing operation after the setting of an image, i.e., after the imaging operation has been performed, the blocking element 65 is pivoted back with the aid of the piston/cylinder unit 51, into the position thereof shown in FIG. 1, whereby the second pivoting lever 19 is released. The pressing device 27 then presses the first pivoting lever 17 with the supporting roller 33 against the rotating cam disk 29 of the drive device 27. In accordance with the course of the outer contour of the cam disk 29, the first pivoting lever 17 and, therefore, also the second pivoting lever 19 and the gripper bar 9 are oscillatingly displaced. In this case, the gripper bar 9, respectively, accepts a sheet at the front lay of the sheet-fed printing machine 1 and transports it to the feed cylinder 5.

With the aid of the cam drive, it is possible to ensure that the law of motion of the pregripper 3 is maintained when the engagement between the supporting roller 33 and the cam disk 29 is resumed. In other words, the cam control advantageously permits synchronous running with other devices in the sheet-fed printing machine 1.

FIG. 3 shows the lever mechanism 1 explained with the aid of FIGS. 1 and 2, the pressing device 37, part of the drive device 27 and a further exemplary embodiment of the blocking device 49. Identical parts are provided with like reference characters, so that to this extent reference is made to the description relating to the preceding figures.

Figure 8:
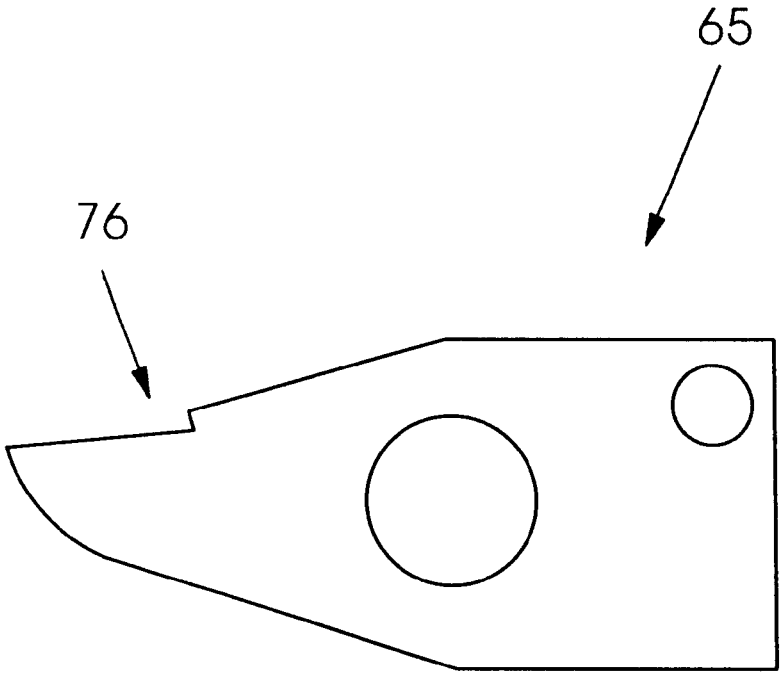
FIG. 8 is an enlarged fragmentary side elevational view of FIG. 1 or 2 showing an exemplary embodiment of a blocking element.

The blocking device 49 differs from the blocking device shown in FIGS. 1 and 2 in particular by the fact that the ratchet-like blocking element 65 is articulatedly connected to a basic body 73 which is pivotable about the pivot shaft 63 and which, in turn, is articulatedly coupled to the second lever 59 of the toggle lever 53. The blocking element 65 is here spring-mounted on the basic body 73. To this end, a spring element 75 formed by a tension spring is provided, which is connected at one end to the blocking element 65 and at the other end thereof to the basic body 73. In the position of the blocking device 47 shown in FIG. 3, the piston rod 68 has been driven out of the housing 69 to such an extent that the first lever 55 moves against the stop 70. In this position, the toggle joint 53 is overpressurized/overstretched, and the blocking element 65 protrudes into the radius of action, illustrated by a broken line 75, of the second pivoting lever 19. If the second pivoting lever 19 is then pivoted in a clockwise direction by the drive device 27, it is displaced against a bevel 77 on the blocking element 65. As a result, the spring-mounted blocking element 65 is pivoted in the counterclockwise direction and forced out of the radius of action of the second pivoting lever 19. The blocking element 65 has a nose 76 (FIG. 8), against which the stop face 71 of the second pivoting lever 19 latches as it sweeps over in the counterclockwise direction of movement. As a result, the malfunction can be detected by a machine operator, because no sheets are transported any more.

The exemplary embodiment of the blocking device 49 illustrated in FIG. 3 offers the advantage that the blocking element 65 is of collision-protected construction, i.e., it is pivotable into the range of movement of the lever mechanism 15 regardless of the respective position of the second pivoting lever 19 of the mechanism, without being damaged by the second pivoting lever 19. Should, therefore, for example, a fault occur in the control/regulating system of the sheet-fed printing machine 1 which leads to undesired activation of the blocking mechanism 49, damage to the lever mechanism 15 as the result of a collision with the blocking element 65 can be ruled out with certainty. It remains to be noted that the forces necessary for the uncoupling are produced by the toggle lever for displacing the blocking element 65. In addition, if the force of the pneumatic cylinder is removed, the toggle joint remains in the overstretched position thereof, so that the pregripper continues to remain uncoupled during the setting of an image.

In an exemplary embodiment not illustrated in the figures, the feed system for feeding the sheets from the feeder to the sheet-fed printing machine has, instead of the lever mechanism as described in accordance with the foregoing figures, a feed gripper, with the aid of which a single sheet can be lifted off the stack or pile and transported to the impression cylinder. The feed gripper preferably transfers the sheet directly to the impression cylinder. In a further exemplary embodiment of the feed system, a gripper bar is provided which is integrated in the feed drum. In order to accept a sheet, the feed drum is pivoted about the axis of rotation thereof in the opposite direction to the transport direction of the sheets. During the operation of the machine, therefore, the feed drum with the integrated gripper bar pivots reciprocatingly at the cyclic rate of the machine. It should be noted that the subject of the invention is not restricted to a feed system having a lever mechanism, but that feed systems with a different construction can be used wherein the common factor is that they can be uncoupled from the drive device.

Figure 4:
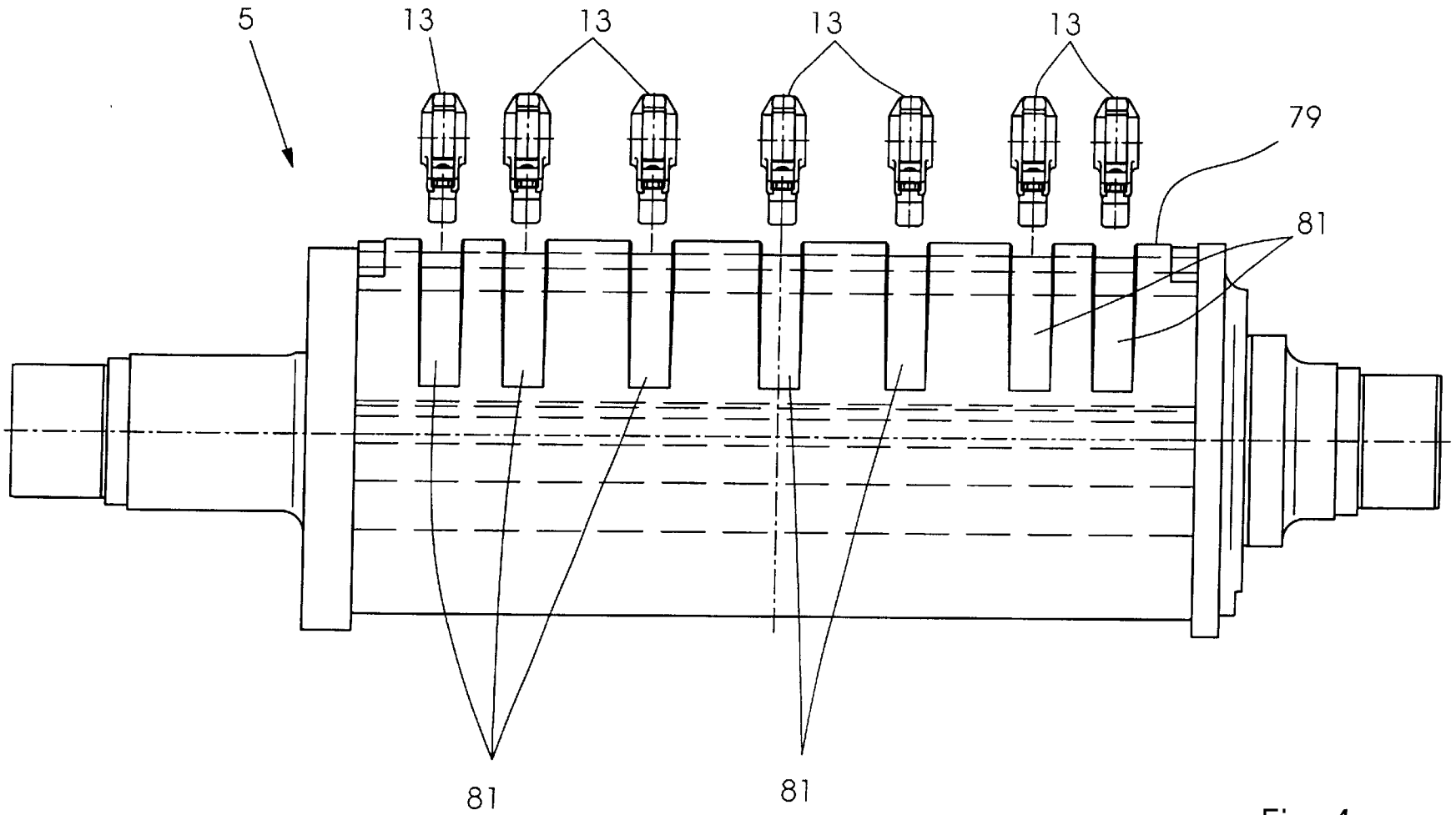
FIG. 4 is an axial view of an exemplary embodiment of a feed cylinder and parts of an exemplary embodiment of the pregripper.

FIG. 4 shows an exemplary embodiment of a feed cylinder 5 which, in the outer circumferential face 79 thereof, has a circumferential groove 81 for each of the grippers 13 of the gripper bar (not illustrated) belonging to the pregripper 3, the depth of the circumferential grooves 81 being selected so that if the lever mechanism 15 fails, the grippers 13 of the pregripper 3 cannot collide with the feed cylinder 5 but dip or plunge into the circumferential grooves 81. The circumferential grooves 81 prevent the grippers 13 from colliding with the feed cylinder 5 exclusively in the event of failure of the clutch (blocking device 49).

Figure 5:
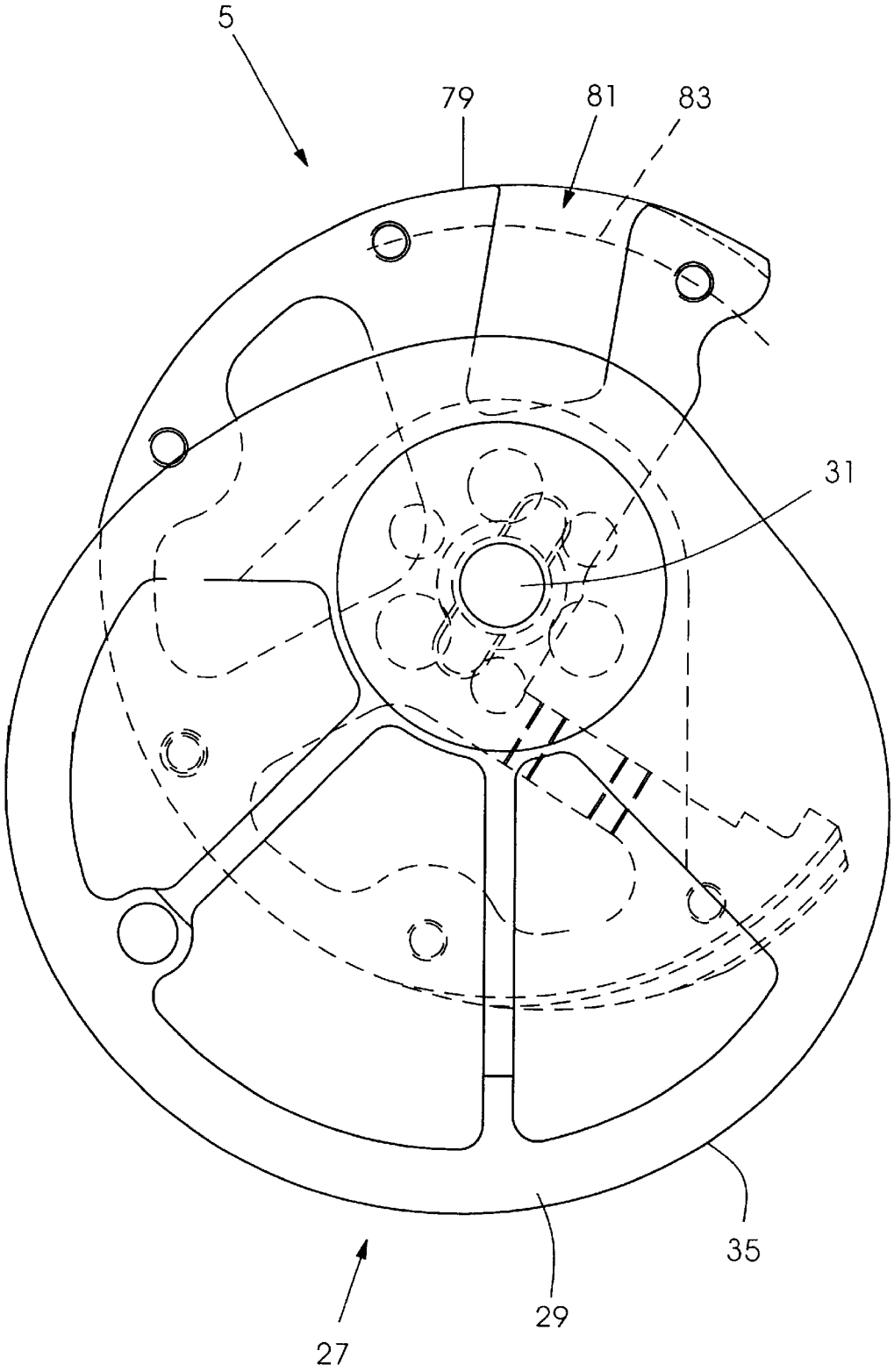
FIG. 5 is an enlarged end view of the feed cylinder of FIG. 4.

FIG. 5 shows an end view of the feed cylinder 5 illustrated in FIG. 4, at which the cam disk 29 of the drive device 27 is mounted. In addition, the bottom of a circumferential groove 81 is illustrated by a broken line 83.

Figure 6:
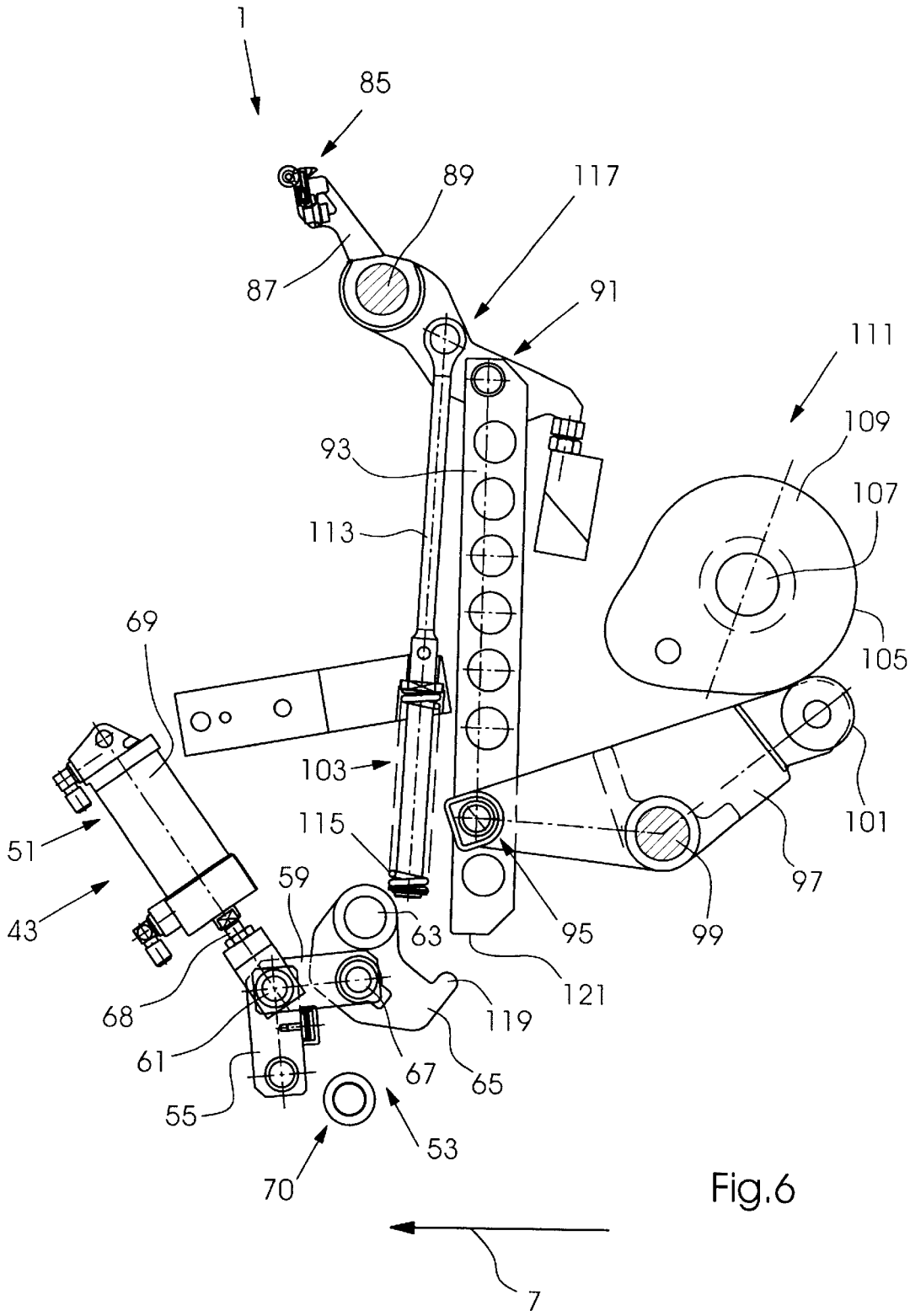
FIGS. 6 and 7 are a side elevational view, in different operating phases, of an exemplary embodiment of a lever mechanism for displacing a front lay into various positions.
Figure 7:
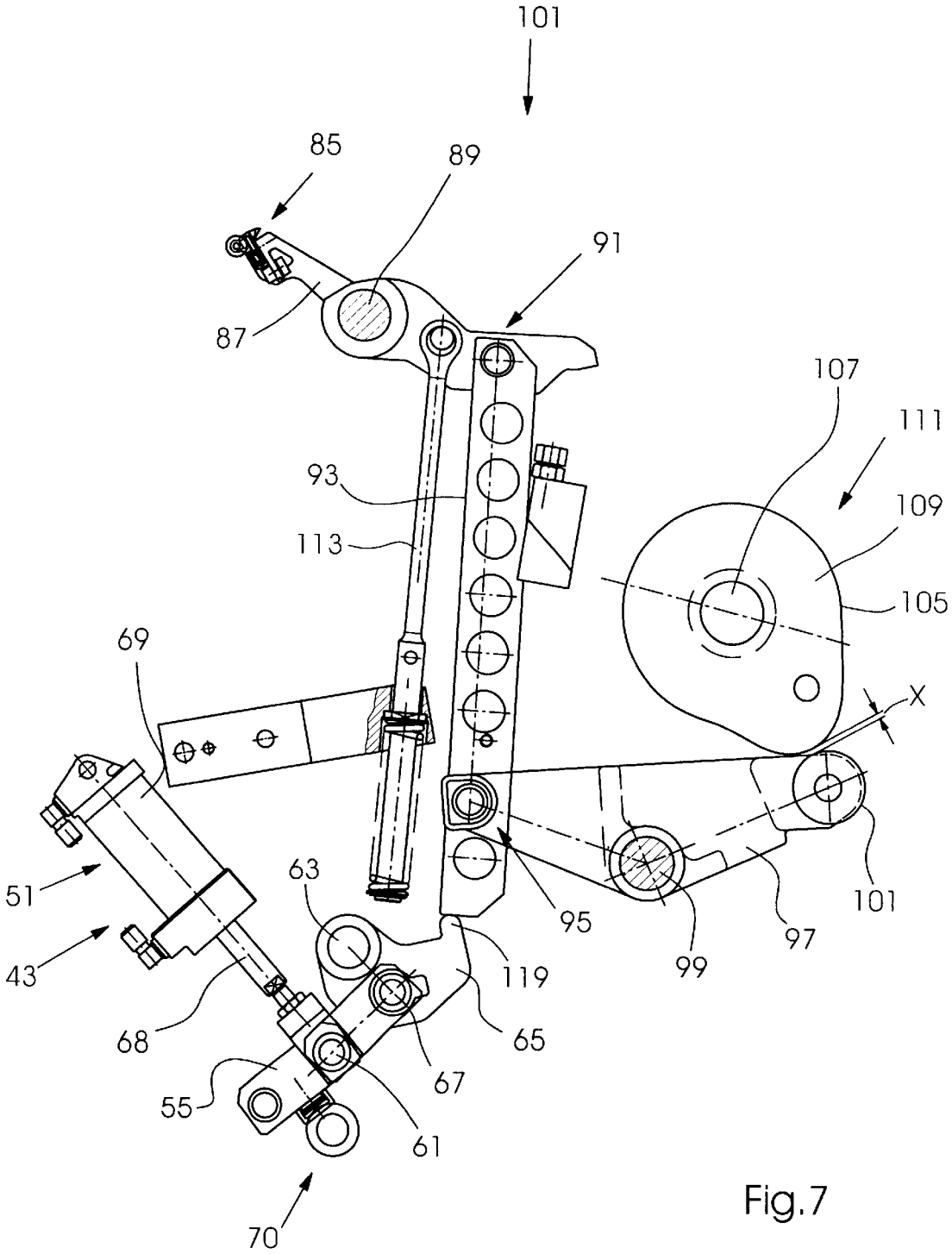

FIGS. 6 and 7 show a detail from a sheet-fed printing machine 1 in the region of a front lay 85, which is used to align the leading edge of the sheets to be processed and separated in the feeder (not illustrated), transversely with respect to the transport direction 7 of the sheets. At the front lay 85, the aligned sheet is accepted by the gripper bar (not illustrated) of a pregripper disposed downline in the transport direction 7. The front lay or lays 85 can be displaced at the cyclic rate of the machine with the aid of a displacement device, which is discussed in greater detail hereinafter.

The front lay 85 is disposed on a lever arm 87, which is pivotable about a fixed second shaft 89. The lever arm 87 is part of a lever mechanism 91 for displacing the front lay 85. The lever mechanism 91 further includes a coupling rod 93 which is articulatedly connected to the lever arm 87 and, in turn, is connected via an articulated joint 95 to a roller lever 97, which is pivotable about a fixed axis 99. The roller lever 97 has a supporting roller 101 which, with the aid of a pressing device 103, can be pressed against the outer circumferential face 105 of a cam disk 109 that is firmly connected to a drive shaft 107 so as to rotate therewith. The cam disk 109 is part of a drive device 111 for the lever mechanism 91, which is constructed here as a cam drive.

In this exemplary embodiment, the pressing device 103 has a construction identical to that of the pressing device 37 described in accordance with the foregoing figures, and has a pull rod 113 which, with the aid of a spring element 115, can be acted upon by a compressive force oriented in the direction of the longitudinal mid-axis of the pull rod 113. The pull rod 113 is connected to the lever arm 87 via an articulated joint 117. In the position of the pressing device 103 illustrated in FIG. 6, the spring element 115 is compressed, the spring force pulling or forcing the pull rod 113 downwardly, as viewed in the vertical direction, as a result of which the lever arm 87, the coupling rod 93, and the roller lever 97 are displaced so that the supporting roller 101 is forced against the cam disk 109 of the drive device 111 and rolls on the latter.

Also provided is a blocking device 43 which, purely by way of example, has a construction identical to that of the blocking device described in accordance with FIGS. 1 and 2. Identical parts are provided with the same reference characters, so that to this extent reference is made to the description relating to the preceding figures. The alignment of the blocking device 43 is chosen here so that the blocking element 65 is arranged underneath the coupling rod 93 aligned in the vertical direction. In the position illustrated in FIG. 6, the blocking element 65 is disposed in the standby position, i.e., is not in the range of movement of the coupling rod 93.

The function of the lever mechanism 91 is as follows: In the position illustrated in FIG. 6, the front lay 85 is disposed in an aligning position, wherein the leading edge of a sheet separated or singled by the feeder is aligned transversely with respect to the transport direction 7 of the sheets. As soon as this has been done, the sheet is accepted and transported onward by the gripper bar of the pregripper (not illustrated). For this purpose, however, it is first necessary for the front lay 85 to be pivoted away in the counterclockwise direction about the second axis 89 and at a high speed, with the consequence that high accelerations also occur. The oscillatory displacement of the front lay 85 with the aid of the lever mechanism 91 is performed in accordance with the outer contour of the cam disk 109 sensed by the supporting roller 101. In order to avoid the introduction of oscillations into the sheet-fed printing machine by the lever mechanism 91 during the setting of an image, which could disrupt the setting of an image on a plate cylinder or the like, the lever mechanism 91 is uncoupled from the drive device 111 before setting the image or performing the imaging operation. For this purpose, the blocking device 43 is activated, the piston rod 68 thereof being extended from the housing 69 to such an extent that the toggle lever 53 moves against the stop 70. At the same time, the blocking element 65 is pivoted in the counterclockwise direction about the pivot shaft 63 and pressed with a nose-like protrusion 119 against a stop face 121 on the coupling rod 93, which is consequently lifted. As a result, the lever arm 87 with the front lay 85 fixed thereto is pivoted in the counterclockwise direction about the pivot shaft 89 into a standby position (FIG. 7). As a result of the raising of the coupling rod 93, the roller lever 97 is pivoted so that the pivoting roller 101 is lifted off the cam disk 109. Between the supporting roller 101 and the cam disk 109 there is a distance X, which can be, for example, 2 mm to 3 mm. The lever mechanism 91 is then uncoupled from the drive device 111 and is at a standstill, while the cam disk 109 can continue to rotate at the machine speed.

After an image has been set on the plate cylinder, the blocking element 65 is pivoted away again in order to couple the lever mechanism 91 to the drive device 111, which results from the pressing device 103 displacing the lever arm 87, the coupling rod 93 and the roller lever 97 so that the supporting roller 101 is pressed against the outer circumferential face 105 of the cam disk 109 again.

From all of the above, it becomes clear that the lever mechanisms 15 and 91 of the pregripper 3 and, respectively, for the front lay 85, are constructed as toggle levers which, of course, can be driven not only by a cam drive but can also be operated in any other way, such as with the aid of an electric motor, if necessary or desirable, with the interposition of a gear mechanism, it being possible for a clutch to be provided in order to uncouple the lever mechanism and the drive device. The cam drive offers the advantage that the law of motion of the pregripper and, respectively, that of the front lay is maintained when the supporting roller engages with the cam disk again.

The uncoupled position of the lever mechanisms 15 and 91 can be registered, for example, by a limit switch. The maintenance of the operating states (standstill, coupling with the drive device) of the lever mechanisms 15, 91 can be monitored by sensors. In the matter of initiating the actuation of the toggle levers, single-fault safety can be implemented in the software of a control and/or regulating device of the sheet-fed printing machine 1 and of the pregripper 3 and of the front lay 85, respectively.

In summary, it remains to be noted that, as a result of uncoupling the lever mechanisms 15, 91 from the drive devices 27, 111, oscillations caused by the oscillatory movements of the lever mechanisms can advantageously be avoided while an image is being set, or imaging is being performed, on the plate cylinder.

We claim:

1. A sheet-fed printing machine having a sheet feeder, a feed cylinder, a feed system for feeding sheets from the sheet feeder to the feed cylinder, and an imaging device for setting an image on a printing plate disposed on a plate cylinder, the feed system comprising:

at least one oscillatingly moving pregripper and a drive device for the feed system, said pregripper being disengagable from said drive device.

2. The sheet-fed printing machine according to claim 1, including a lever mechanism for driving said pregripper.

3. The sheet-fed printing machine according to claim 2, including a blocking device for blocking said lever mechanism in a given functional position.

4. The sheet-fed printing machine according to claim 2, wherein said drive device is constructed as a cam drive having at least one cam disk connected to a drive shaft so as to be fixed against rotation relative thereto, said cam disk cooperating with a first pivoting lever of said lever mechanism, and being pivotable about a fixed axis.

5. The sheet-fed printing machine according to claim 4, including a pressing device for pressing said first pivoting lever against said cam disk.

6. The sheet-fed printing machine according to claim 4, wherein said lever mechanism has a second pivoting lever connected to a shaft for said pregripper so as to be fixed against rotation relative thereto, and a gripper bar is fixed to said pregripper shaft.

7. The sheet-fed printing machine according to claim 6, wherein said pressing device is in cooperative engagement with at least one of said pregripper shaft and said second pivoting lever.

8. The sheet-fed printing machine according to claim 6, wherein said first and said second pivoting levers are articulatedly connected to a coupling element.

9. The sheet-fed printing machine according to claim 8, wherein said first pivoting lever has at least one supporting roller which, in a non-blocked state of said lever mechanism, rolls on said cam disk, said supporting roller, in a blocked state of said lever mechanism, being located at a given distance from said rotating cam disk.

10. The sheet-fed printing machine according to claim 1, wherein said pregripper has at least one gripper bar displaceable with a displacement at a cyclic rate of the printing machine.

11. The sheet-fed printing machine according to claim 10, wherein the displacement of said at least one gripper bar at the cyclic rate of the printing machine is non-uniform.

12. The sheet-fed printing machine according to claim 10, wherein the displacement of said at least one gripper bar at the cyclic rate of the printing machine is in an oscillatory manner.

13. The sheet-fed printing machine according to claim 10, wherein said gripper bar has at least one gripper, and the feed system includes a feed cylinder formed, for said at least one gripper, with a respective circumferential groove into which said at least one gripper is dippable as it approaches said feed cylinder.

14. The sheet-fed printing machine according to claim 13, wherein a respective circumferential groove is of such depth that even when said at least one gripper is at a minimal distance from axis of rotation of said feed cylinder, there is an interspace between said at least one gripper and the bottom of the respective circumferential groove.

15. The sheet-fed printing machine according to claim 10, wherein said gripper bar has a plurality of grippers, and the feed system includes a feed cylinder formed, for said plurality of grippers, with a plurality of respective circumferential grooves into which said grippers, respectively, are dippable as they approach said feed cylinder.

16. The sheet-fed printing machine according to claim 1, wherein said pregripper is disposed between the sheet feeder and the feed cylinder.

17. A method of operating a sheet-fed printing machine having a feed system for feeding sheets from a feeder to the sheet-fed printing machine, which comprises:

providing an imaging device for setting an image on a printing plate disposed on a plate cylinder; and uncoupling parts of at least one feed system for transporting the sheets from a drive, while the image is being set on the printing plate.

18. The method according to claim 17, which comprises uncoupling at least one of a gripper bar of a pregripper from the drive.

* * * * *